US006818869B2

(12) United States Patent
Patti et al.

(10) Patent No.: US 6,818,869 B2
(45) Date of Patent: Nov. 16, 2004

(54) MULTIPLE PANEL OVEN HAVING INDIVIDUAL CONTROLS FOR COMBINED CONDUCTIVE AND RADIANT HEATING PANELS

(75) Inventors: Anthony Patti, Wakefield, MA (US); Mimmo Elia, Watertown, MA (US); William E. Lyle, Malden, MA (US); Darrell J. King, Belmont, MA (US)

(73) Assignee: Tiax LLC, Cambridge, MA (US)

( * ) Notice: Subject to any disclaimer, the term of this patent is extended or adjusted under 35 U.S.C. 154(b) by 0 days.

(21) Appl. No.: 10/234,887

(22) Filed: Sep. 4, 2002

(65) Prior Publication Data

US 2003/0047553 A1 Mar. 13, 2003

Related U.S. Application Data

(60) Provisional application No. 60/318,078, filed on Sep. 7, 2001.

(51) Int. Cl.[7] ..... H05B 1/02

(52) U.S. Cl. ..... 219/489; 219/486; 219/387; 219/395; 219/406; 219/506; 99/328; 99/333

(58) Field of Search ..... 219/483, 486, 219/489, 485, 395, 497, 501, 506, 406, 411–414, 400–402, 398, 387, 505; 99/325–333; 307/38–41

(56) References Cited

U.S. PATENT DOCUMENTS

| | | | | |
|---|---|---|---|---|
| 2,683,795 | A | 7/1954 | Sheidler et al. | 219/35 |
| 3,674,982 | A | 7/1972 | Hoyt et al. | 219/403 |
| 3,886,346 | A | 5/1975 | Meyers | 219/386 |
| 4,164,643 | A | 8/1979 | Peart et al. | 219/411 |
| 4,455,319 | A | 6/1984 | Clark | 426/233 |
| 4,757,184 | A | 7/1988 | Swanson et al. | 219/400 |
| 4,780,597 | A | 10/1988 | Linhart et al. | 219/404 |
| 5,205,273 | A | 4/1993 | Sparks et al. | 126/21 |
| 5,272,317 | A | 12/1993 | Ryu | 219/403 |
| 5,315,922 | A | 5/1994 | Keller | 99/447 |
| 5,404,935 | A | 4/1995 | Liebermann | 165/48.1 |
| 5,665,258 | A | 9/1997 | Hsu | 219/388 |
| 5,720,273 | A | 2/1998 | Trullas | 126/275 |
| 5,845,631 | A | 12/1998 | Kleva et al. | 126/21 |
| 5,880,434 | A | 3/1999 | Pinnow et al. | 219/386 |
| 5,900,173 | A | 5/1999 | Robards, Jr. | 219/392 |
| 5,938,959 | A | 8/1999 | Wang | 219/401 |
| 5,994,673 | A | 11/1999 | El-Shoubary et al. | 219/403 |
| 6,111,224 | A | 8/2000 | Witt | 219/385 |
| 6,114,665 | A | 9/2000 | Garcia et al. | 219/404 |

*Primary Examiner*—Mark Paschall
(74) *Attorney, Agent, or Firm*—Pearson & Pearson, LLP

(57) ABSTRACT

A multiple panel cooking oven having individual controls for combined conductive and radiant heating. Each panel comprises an upper heating element for conductive heating and a lower heating element for radiant heating to obtain uniform baking within a zone between panels in the oven. A control panel having displays and keypads interfaces with a processor which provides control signals for adjusting the temperature of the heating elements of the panels. Cooking energy efficiency is increased through the use of radiative and conductive heat transfer, to reduce bake times by significantly increasing heat transfer to the food products. Independent cook zones allow preparation of multiple products simultaneously under different cooking conditions. The oven, in one embodiment may include a convection heating mode of operation. In an alternative embodiment no convection mode is provided and the sole source of heat is provided by the conductive/radiant panels.

21 Claims, 16 Drawing Sheets

MULTIPLE PANEL OVEN HAVING INDIVIDUAL CONTROLS FOR COMBINED CONDUCTIVE AND RADIANT HEATING PANELS

CROSS-REFERENCE TO RELATED APPLICATIONS

This is a nonprovisional application claiming priority of provisional application for Pat. Ser. No. 60/318,078, filed Sep. 7, 2001.

BACKGROUND OF THE INVENTION

1. Field of the Invention

This invention relates to cooking ovens having a plurality of panels for foodservice cooking operations, and in particular to a multiple panel oven having various sizes of panels for various sizes of ovens and individual controls for heating a conductive side of each panel and a radiant side of each panel. In one embodiment the oven has a convection heating mode of operation in addition to the conduction/radiant mode of operation. Other embodiments do not include the convection mode of operation.

2. Description of Related Art

In many food service operations, the oven appliance is considered to be the workhorse appliance. The oven may be gas or electric powered and has changed very little over many years, although it is typically characterized as being just "okay" in baking performance. The biggest complaint by food service operators is with baking uniformity. Current baking ovens provide less than adequate baking which requires the operator, i.e. chef, cook, etc., to continually monitor the baking progress as well as having to rotate and shift the products to achieve the desired results. Considerable work has been performed to improve baking performance. The typical approach has been to manipulate the airflow to "even-out" the heat transfer throughout the oven cavity. Such approaches have produced marginal results as evidenced by today's best oven performance, and usually do not satisfy most food service operators.

In U.S. Pat. No. 2,683,795, issued to Robert G. Sheidler et al., on Jul. 13, 1954, a portable electric cooking oven is disclosed comprising a plurality of vertically spaced trays removably mounted in the oven chamber upon suitable trays which are secured to the sides of the inner casing. Each tray has incorporated therein an electric resistance heating element which is connected to suitable plugs carried by the tray and which engage suitable outlet sockets mounted in the rear wall. Turning on the heating is controlled by an electric switch. When energized the heating elements heat the trays which in turn heat the air in the oven chamber and any utensils on the trays. The oven is designed to cook different foods providing they have the same cooking time at the same temperature. Therefore, foods requiring different cooking temperatures cannot be accommodated by this oven.

In U.S. Pat. No. 5,272,317, issued Dec. 21, 1993 to Wook R. Ryu, and assigned to Samsung Electronics Co., Ltd., a cooking oven is disclosed having a cooking compartment with removable shelves. Each shelf includes a frame and a removable resistance heater. The heater plugs into an electrical socket 21 formed in the back wall of the compartment. The heater is of a zig-zag shape, which increases the amount of radiation the heater 34 provides to the surface of the metal grill. In another embodiment, the metal grill comprises thin metal rods using a Z-shaped sheet secured by the periphery of the heater. The heater comprises a heating wire for emitting heat, and a mica sheet having a groove for receiving the heating wire which extends in a zig-zag shape; also, a couple of the mica sheets blanket the upper and lower surfaces of the wire. A tray can be placed on a lower rail and receives radiant heat for cooking another food item. However, there are no individual controls for providing different cooking temperatures for foods placed in the oven.

In U.S. Pat. No. 5,720,273, issued Feb. 24, 1998 to Francese S. Trullas, an oven for receiving and heating cooking vessels is disclosed comprising a plurality of heating units arranged in different parallel planes. A cooking vessel is positionable in association with each heating element on rods. A protecting plate is attached to the rods beneath the rear part of each one of the resistor elements in order to prevent the concentration of heat on the cooking vessel. However, the heating elements are not individually controllable.

In U.S. Pat. No. 5,994,673, issued Nov. 30, 1999, to Youssef El-Shoubary et al. and assigned to General Electric Company, a variable volume oven is disclosed which is adjusted according to the cooking load. A heating element is vertically adjustable within the oven to a position that provides better convection and radiative heating to the cooking load. A fixed heating element is located below the top wall of the chamber. In another embodiment a third heating element is added to create another independent oven within the variable volume oven. The first and second ovens can be controlled by adding independent oven controls for each oven. However, this oven does not provide a top heating element for conductive heating and a bottom heating element for radiant heating, each being individually temperature controllable.

In U.S. Pat. No. 3,674,982, issued Jul. 4, 1972 to Edwin D. Hoyt et al., a zone controlled cook oven is disclosed having a plurality of vertically spaced support shelves in a cabinet. The shelves are provided with one or more electric resistance heater elements arranged within the shelves at the time they are cast. Each shelf is provided with a heat sensing element for maintaining the temperature of the shelf. The temperature in each zone is maintained at the set temperature by radiant and conductive heat from the upper and lower shelves which define the zone and by convection of heat about the perimeters of the shelves and through the heat conducting openings about the shelves. A plate placed on the shelf receives heat conducted directly to the plate and the plate is heated by radiant heat from that shelf and the next upper shelf and by convection of heat from the heated ambient atmosphere or air in the zone defined by the shelves and in which the plate and food are deposited. However, this cook oven does not provide for individual temperature controls of the upper and lower heating elements combined into a single shelf.

In U.S. Pat. No. 5,404,935, issued Apr. 11, 1995 to Benno E. Liebermann, a vertical oven cabinet is disclosed having the dual function of heating or cooling food articles. The cabinet comprises a plurality of removable, vertically spaced-apart support shelves of a conductive material. Also, the invention provides for heating and cooking of food articles by circulating a thermal liquid fluid through a heating channel having a serpentine configuration in each shelf. An electrical power conduit is enclosed entirely within each shelf.

It would be beneficial to have a cooking oven that overcomes the limitations of the prior art by improving baking uniformity.

SUMMARY OF THE INVENTION

Accordingly, it is therefore an object of this invention to provide a cooking oven having a plurality of panels, each panel having an upper independently controlled conductive heating element and a lower independently controlled radiant heating element.

It is a further object of this invention to provide a cooking oven having a plurality of panels forming cooking zones, each panel having an upper independently controlled heating element for providing conductive and/or radiant heating and a lower independently controlled heating element for providing radiant heating.

It is another object of this invention to provide baking uniformity within baking trays located on any panel within the cooking oven by conductive and/or radiant heating of individual zones.

It is another object of this invention to provide removable panels having upper and lower surface heating elements comprising common types of such elements such as thermal film ink substrates or resistance wire designs such as ni-chrome, the heating elements being separated by an insulation section.

It is another object of this invention to provide a control panel having a keypad user interface to adjust the settings of the heating elements in the panels and multiple displays to convey controller information to the user.

It is another object of this invention to provide various sized cavities in the cooking oven for greater efficiency when cooking foods requiring different cooking vessels by the removal of one or more of the panels.

It is another object of this invention to provide a cooking oven with an independently controlled conductive/radiant mode of operation wherein the independent control pertains to each of the cooking zones between panels as well as to each of the radiant and conductive heating elements within each zone.

It is still another object of this invention to provide a cooking oven with independently controlled conductive/radiant panels as well as a convection mode of operation.

These and other objects are accomplished by a cooking oven comprising a heat insulated cabinet having a top, bottom, rear and side walls and an access door attached to the front of the cabinet, a plurality of heating panels spaced-apart within the cabinet, each of the panels having an upper and a lower surface and comprising means for heating the upper surface of each of the panels and means for heating the lower surface of each of the panels, the upper surface and the lower surface of each panel being separated by insulation, means connected to the heating panels for separately controlling the heat output of each upper surface of each of the plurality of heating panels, and means connected to the heating panels for separately controlling the heat output of each lower surface of each of the plurality of panels. The oven comprises means for providing a convection heating mode of operation. The oven comprises a control panel positioned adjacent to the access door for providing a user interface with controls and displays. The oven comprises a processor connected to the control panel for operating the cooking oven in response to signals received from the control panel. The control panel monitors the electrical current or continuity powering each panel as a means for reconfiguring the size of each of the heating zones formed between the spaced-apart panels. The upper surface of the panels provides conduction heating for a first cooking tray placed on the upper surface of a first one of the heating panels and the lower surface of the first one of the panels provides radiant heating for a second cooking tray placed on an adjacent second one of the panels under the lower surface of the first one of the heating panels. Also, the upper surface of the panels comprises means for providing conduction and radiant heating for a first cooking tray placed on the upper surface of a first one of the heating panels and the lower surface of the first one of the panels provides radiant heating for a second cooking tray placed on an adjacent second one of the panels under the lower surface of the first one of the heating panels. Further, the upper surface of the panels provides radiant heating for a first cooking tray placed slightly above the upper surface of a first one of the heating panels and the lower surface of the first one of the panels provides radiant heating for a second cooking tray placed on or slightly above an adjacent second one of the panels under the lower surface of the first one of the heating panels. The means for separately controlling the heat output of the upper surface of the plurality of heating panels comprises a software routine operating in response to control signals from a user interface panel. The means for separately controlling the heat output of the lower surface of the plurality of heating panels comprises a software routine operating in response to control signals from a user interface panel. Each of the upper surface of each of the panels and each of the lower surface of each of the panels comprises a metal substrate, a dielectric applied to the metal substrate, and a thermal film ink bonded to the dielectric. The dielectric comprises a borosilicate glass. In an alternate embodiment, the upper surface of the panels and the lower surface of the panels comprises a resistive element embedded in an insulative bed. The oven comprises means for enabling each of the panels to be connected or disconnected from the cooking oven.

The objects are further accomplished by a heating panel of a cooking oven having upper and lower surfaces comprising means for separately heating the upper surface and the lower surface, the upper surface and the lower surface being separated by insulation, and means for controlling the heating means in response to operator inputs to a user interface panel. The upper surface may comprise peaks and valleys for providing conductive and radiant heating. Each surface comprises a metal substrate, a dielectric applied to the metal substrate, and a thermal film ink bonded to the dielectric. The dielectric comprises a borosilicate glass. In an alternate embodiment, each of the upper surface and the lower surface of the heating panel comprises a resistive element embedded in an insulative bed.

The objects are further accomplished by a cooking oven comprising a plurality of cooking zones, each of the cooking zones being formed by an upper heating panel and a lower heating panel, each heating panel comprises an upper heating surface and a lower heating surface separated by insulation, and means for separately controlling the heat output of the upper heating surface and the lower heating surface of the heating panel forming said cooking zones. The oven comprises means for providing a convection heating mode of operation. The oven comprises a control panel positioned adjacent to an access door for providing a user interface with controls and displays. The cooking oven comprises means for varying the sizes of each of the cooking zones. The upper heating surface of the heating panel provides conduction heating in a first one of the plurality of cooking zones for a first cooking tray placed on the upper heating surface of a first heating panel and the lower heating surface of the first heating panel provides radiant heating in a second one of the plurality of cooking zones for a second cooking tray placed on an adjacent second heating panel under the lower heating surface of the first heating panel. Also, the upper heating surface of the heating panel comprises means for providing conduction and radiant heating in a first one of the plurality of cooking zones for a first cooking tray placed on the upper heating surface of a first heating panel and the lower heating surface of the first heating panel provides radiant heating in a second one of the plurality of cooking zones for a second cooking tray placed on an adjacent second heating panel under the lower heating surface of the first heating panel. Further, the upper heating surface of the heating panel provides radiant heating in a first one of the plurality of cooking zones for a first cooking tray placed slightly above the upper heating surface of a first heating panel and the lower heating surface of the first heating panel provides radiant heating in a second one of the plurality of cooking zones for a second cooking tray placed on or slightly above an adjacent second heating panel under the lower heating surface of the first heating panel. The means for separately controlling the heat output of the upper heating surface and the lower heating surface of each of the heating panels comprises a software routine operating in response to control signals from a user interface panel. The oven comprises means for enabling each of the panels to be connected or disconnected from the cooking oven.

The objects are further accomplished by a cooking oven comprising at least one cooking zone, formed by a lower heating element of a first heating panel and an upper heating element of a second heating panel positioned below the first heating panel in the oven, each heating panel comprises an upper heating surface and a lower heating surface separated by insulation, and means for independently controlling the heat output of the upper heating surface and the lower heating surface of each heating panel forming said cooking zone. The oven comprises means for providing a convection heating mode of operation. The oven comprises a control panel positioned adjacent to an access door for providing a user interface with controls and displays. The upper heating surface of the second heating panel provides conduction heating for a cooking tray placed on the upper heating surface of the second heating panel and the lower heating surface of the first heating panel provides radiant heating for the cooking tray placed on the second heating panel below the lower heating surface of the first heating panel. Also, the upper heating surface of the second heating panel comprises means for conduction and radiant heating for a cooking tray placed on the upper heating surface of the second heating panel and the lower heating surface of the first heating panel provides radiant heating for the cooking tray placed on the second heating panel below the lower heating surface of the first heating panel. Further, the upper heating surface of the second heating panel provides radiant heating for a cooking tray placed slightly above the upper heating surface of the second heating panel and the lower heating surface of the first heating panel provides radiant heating for the cooking tray placed slightly above the second heating panel below the lower heating surface of the first heating panel.

The objects are further accomplished by a method of providing a cooking oven comprising the steps of providing a heat insulated cabinet having a top, bottom, rear and side walls and an access door attached to the front of the cabinet, positioning a plurality of heating panels spaced-apart within the cabinet, each of the panels having an upper and a lower surface and comprising means for heating the upper surface of each of the panels and means for heating the lower surface of each of the panels, the upper surface and the lower surface of each panel being separated by insulation, controlling individually the upper surface heating means for each of the panels, and controlling individually the lower surface heating means for each of the panels. The method comprises the step of providing a convection heating mode of operation. The step of positioning a plurality of heating panels within the cabinet, each of the panels having an upper surface and a lower surface and comprising means for heating the upper surface and the lower surface further comprises the step of providing means for conductive heating and radiant heating a first cooking tray placed on the upper surface of a first one of the heating panels and the lower surface of the first one of the panels providing radiant heating for a second cooking tray placed on an adjacent second one of the heating panels under the lower surface of the first one of the heating panels. The step of positioning a plurality of heating panels spaced-apart within the cabinet, each of the panels having an upper and a lower surface further comprises the step of providing the upper surface with peaks and valleys for conductive and radiant heating. The step of controlling individually the upper surface heating means for each of the panels comprises the step of providing a software routine to operate in response to control signals from a user interface panel. The step of controlling individually the lower surface heating means for each of the panels comprises the step of providing a software routine to operate in response to control signals from a user interface panel.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
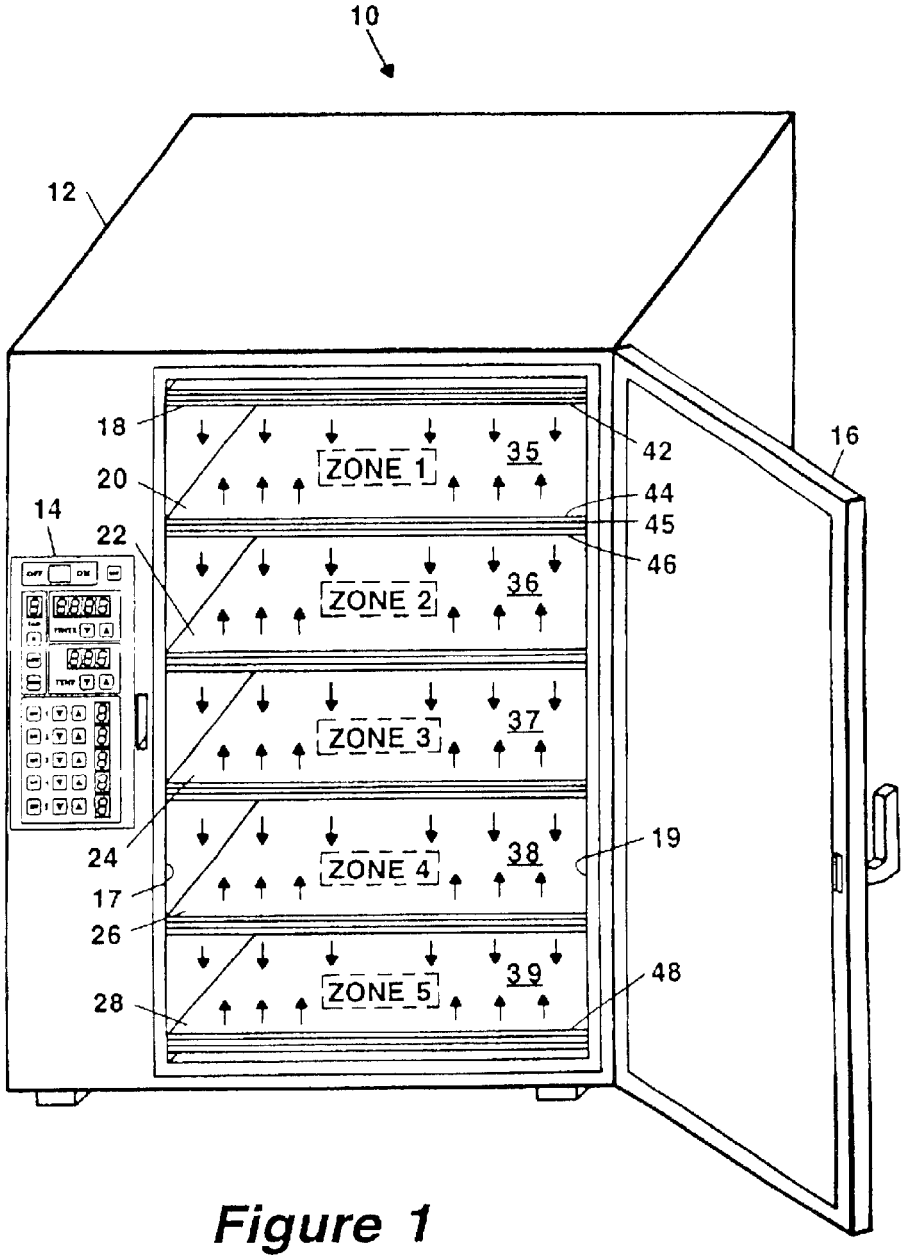
FIG. 1 is a perspective view of a multiple panel cooking oven according to the present invention providing, via a control panel, independently controlled conduction and radiant heating elements and in one embodiment an optional convection heating element.

Referring to FIG. 1, a perspective view of the invention of a cooking oven 10 is shown comprising a plurality of panels 18, 20, 22, 24, 26, and 28 forming a plurality of cooking zones 35–39 within an enclosure 12 and a control panel 14. These cooking zones are referred to as Zone 1, Zone 2, Zone 3, Zone 4 and Zone 5 respectively. The oven 10 includes a convection heating mode of operation and a combined radiation and conduction mode of operation. The oven enclosure 12 includes a door 16 for easy access to the panels 18–28, and the control panel 14 is positioned adjacent to the door 16.

Each panel 18, 20, 22, 24, 26, 28 extends horizontally from one side 17 of the oven 10 to an opposite side 19 and comprises an upper heating element 44, a lower heating element 46 and an insulation section 45 between such heating elements 44 and 46. Panel 18 utilizes only the lower heating element 42 because it is a top panel in the oven 10 and only needs to provide radiant heating. Panel 28 utilizes only the upper heating element 48 because it is the bottom panel in the oven 10. Panels 18 and 28 may be embodied by the same panel used for panels 20–26 or may be embodied by a single heating element panel depending on space and cost parameters. Panels 20–26, as shown in FIG. 1, are removable to enlarge the size of one or more of the cooking zones 35–39; as each panel is removed to increase the size of a zone, the number of zones decreases by 1.

Still referring to FIG. 1, when a cooking pan is placed, for example, in zone 1, on the upper heating element 44 of panel 20 conduction heating occurs and the cooking pan also receives radiant heating from the lower heating element 42, of the panel 18. However, if the cooking pan is positioned in the oven 10 so that it is slightly raised and not in contact with the heating surface of heating element 44, then the cooking pan receives radiant heating from the upper heating element 44 of panel 20 as well as radiant heating from the lower heating element 42 of panel 18.

In another embodiment the upper heating surface of heating element 44 of panel 20 comprises peaks and valleys such as a dimpled surface design. With this dimpled surface a cooking pan or a food product such as a pizza sitting directly on such surface would receive conductive heating from the points on the pan in contact with the peaks of the dimpled surface and radiant heating from the valleys of the dimpled surface.

The oven 10 comprises a control panel 14 with an individual control for each heating element of panels 18–28 for providing individual power levels for each heating element of each panel. The combination of radiation heating and conductive heating enhances the cooking energy efficiency within the oven 10 and results in very uniform baking performance and significant cook time reduction. Flexible individual panel element control allows an operator to tailor each panel's performance to the individual food product's needs.

Figure 2:
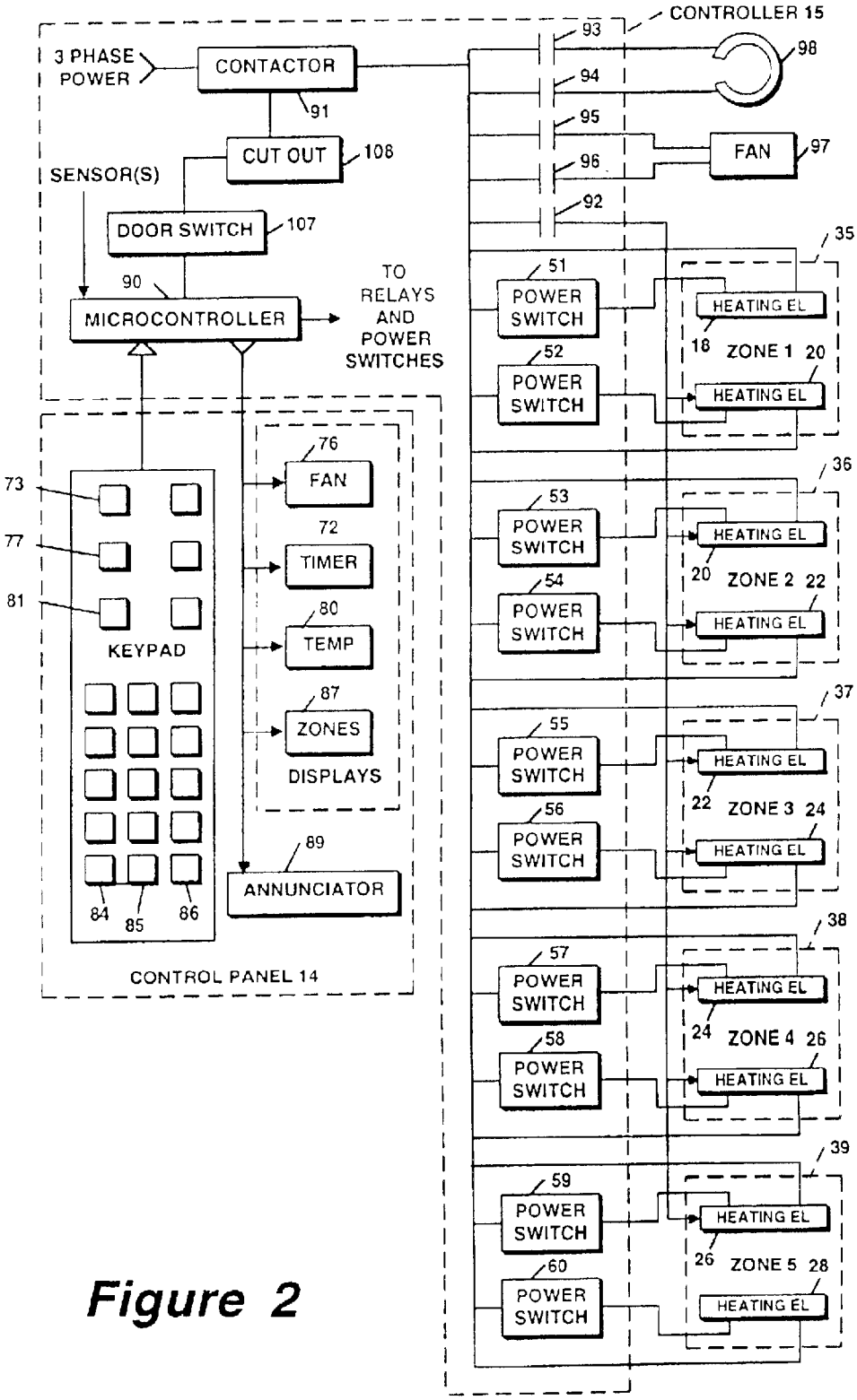
FIG. 2 is a block diagram of the interconnections between the control panel and the heating elements of each panel of the oven of FIG. 1 according to the present invention.
Figure 4:
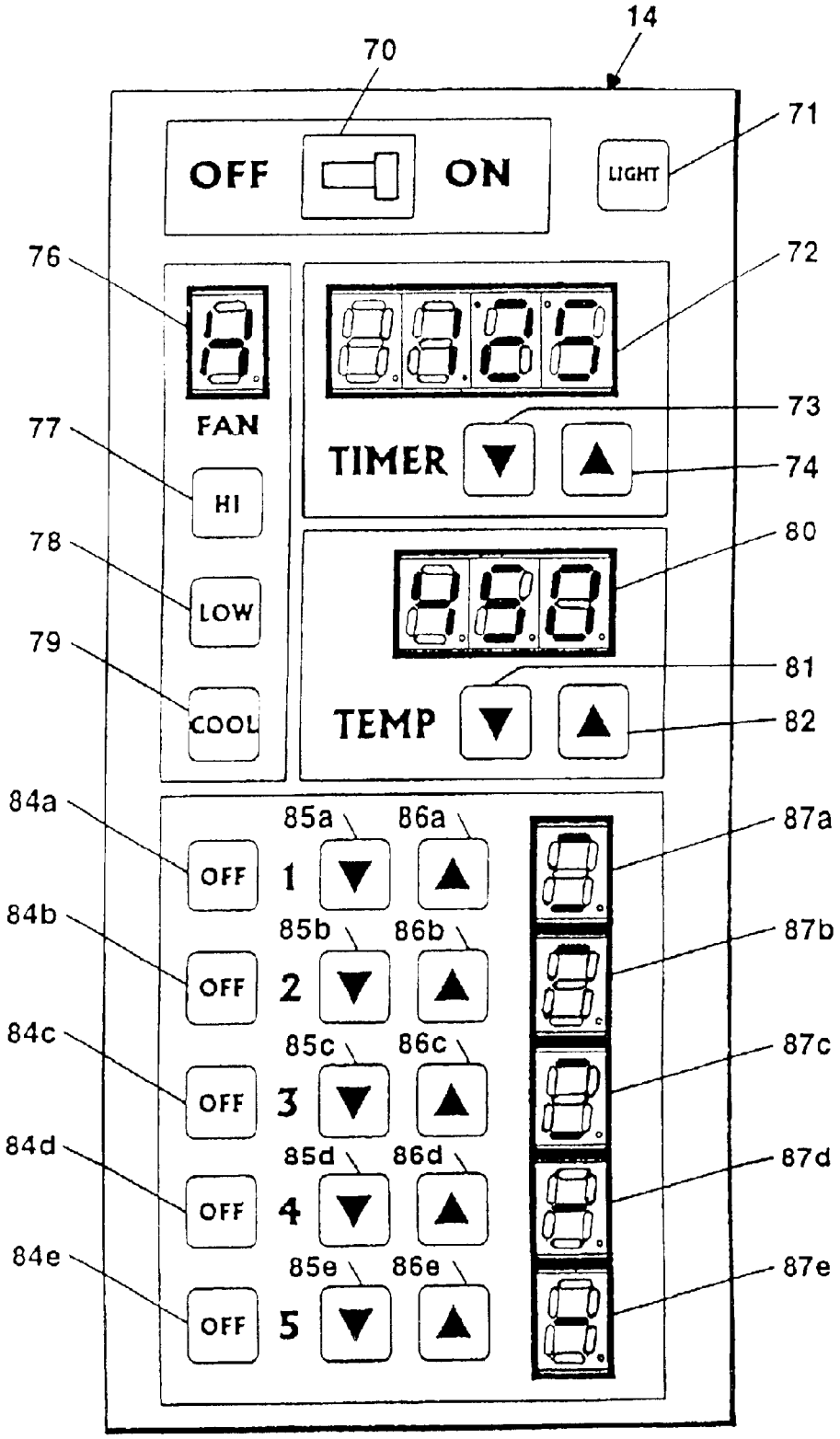
FIG. 4 is a front elevational view of the control panel showing a user interface keypad and numeric displays.

Referring to FIG. 2 and FIG. 4, FIG. 2 is a block diagram of the interconnections between the control panel 14 and each panel 18–28 of the oven 10. FIG. 4 is a front elevational view of the control panel 14. The control panel 14 comprises button switches 71, 73, 74, 77–79, 81, 82, 84*a*–84*e*, 85*a*–85*e*, 86*a*–86*e*, and displays 72, 76, 80 and 87*a*–87*e* which interface with a processor or microcontroller 90. The microcontroller 90 controls relays 92–96 and power switches 51–60 in accordance with the selected mode on the control panel 14. The microcontroller 90 may be embodied by Model PIC16F88, manufactured by Microchip, of Chandler, Ariz. or Model ST92F124R9 manufactured by STMicroelectronics of Geneva, Switzerland.

A power switch 70 located at the top of the control panel 14 is provided for switching single-phase AC power ON and OFF to the control panel 14. A 3-phase contactor 91 under the control of the microcontroller 90 switches the AC power to heating elements 44 and 46 for controlling each of the cooking zones 35–39. The contactor 91 passes power through relays 92, 93, 94, 95 and 96 which control the AC voltage to a fan 97, convection heating element 98, and panels 18–28 comprising heating elements 44 and 46. Each of the heating elements 44 and 46 receives the AC voltage via one of the power switches 51–60.

The power switches 51–60 are implemented with triac switches. Of course other power switching devices may be used such as solid state or electromechanical relays or silicon controlled rectifiers (SCRs) known in the art. The triac switches may be embodied by Model NTE5638, manufactured by NTE Electronics, of Bloomfield, N.J. or Model BTA12-600SW manufactured by STMicroelectronics of Geneva, Switzerland. Each heating element 44 and 46 of panels 18–28 is controlled by the control panel 14 via the microcontroller 90, whereby different power levels can be selected for cooking different foods in different cooking zones 35–39, and each of the heating elements 44 and 46 in each of the panels 18–28 can be turned ON and OFF or controlled variably by phase firing or pulse width modulation to a predetermined percentage duty cycle. The contactor 91 may be implemented with a 3-pole contactor rated at 40 AMPS per pole. The contactor 91 and the power switches 51–60 have a power rating in accordance with the rating of the heating elements used. In the present embodiments each heating element is rated at 750 watts. The contactor 91 may be embodied by FURNAS model 42BF35AG, manufactured by Siemens Automation and Energy of Alpharetta, Ga.

Figure 3:
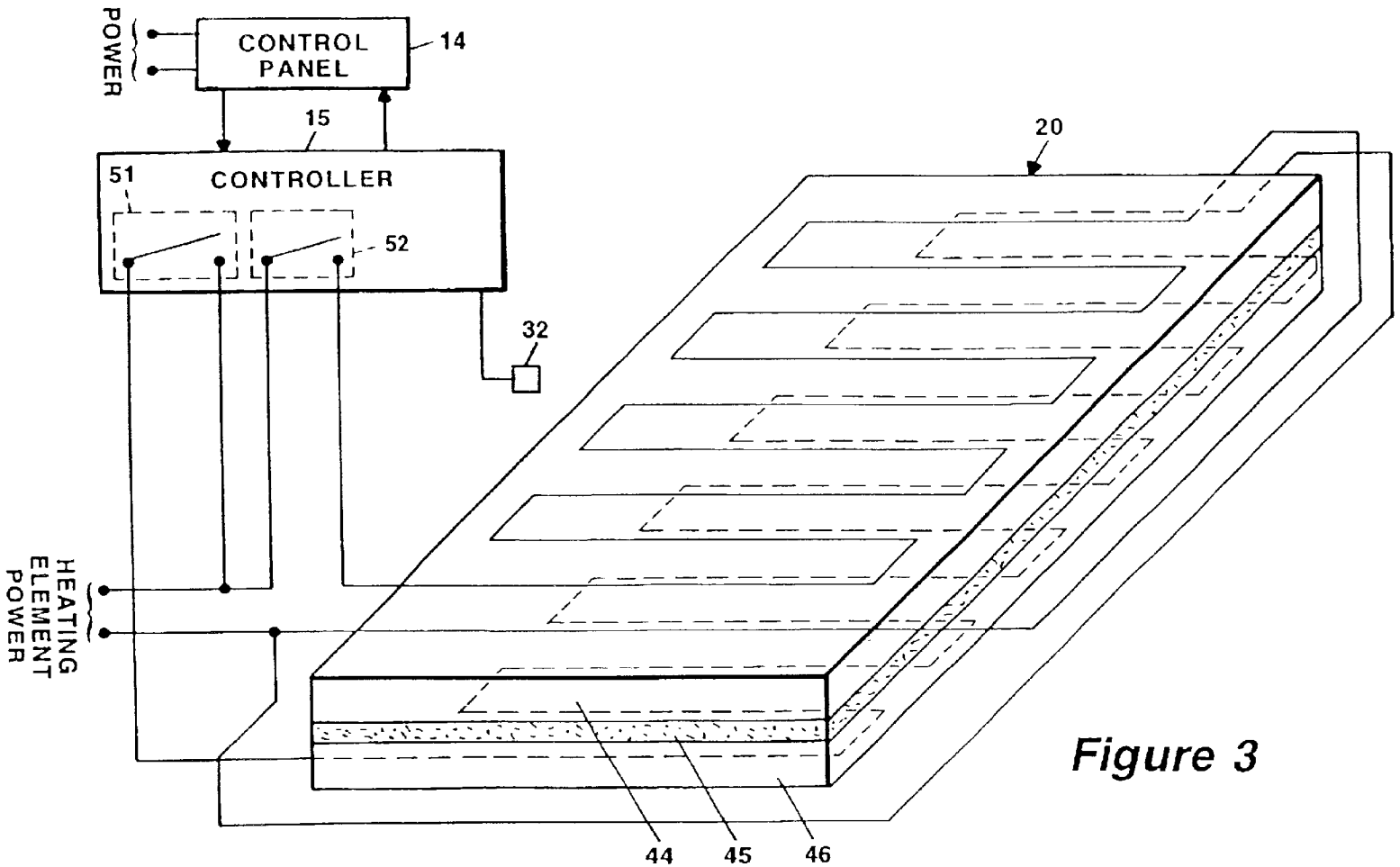
FIG. 3 is a perspective view of the heating elements in a panel, having an upper element for conductive heating and lower element for radiant heating, connected to a power controller which interfaces with the control panel.

Referring now to FIG. 3, a perspective view of the heating elements 44 and 46 in a panel 20 of panels 18–28 is shown, each panel comprising an upper heating element 44 for providing conductive and/or radiant heating and a lower heating element 46 for radiant heating, as well as an insulating section 45 positioned between the heating elements 44 and 46. A temperature sensor 32 is positioned within the cavity of the oven 10 on the front upper portion of side 17.

The heating elements 44 and 46 of the panels 18–28 of the preferred embodiment comprise a very thin thermal film ink which is bonded to a dielectric such as borosilicate glass which is applied to a metal substrate, typically 430 series stainless steel. In another embodiment, a resistive element such as thin gage ni-chrome wire is embedded in an insulative bed, such as in ceramic, within one of various pattern arrangements. Each panel thickness is approximately seven-sixteenths inch, and each panel plugs in and out of connectors (not shown). Panels 20–26 are removable for easy cleaning and oven configurability. The panels 18–28 may be embodied by heating panels as described above manufactured by Ferro Techniek BV of 7011 AT Gaanderen, The Netherlands.

Referring again to FIG. 4, the front elevational view of the control panel 14 comprises a user interface keypad, displays and a power switch 70. The power switch 70 turns the oven 10 ON and OFF, and a light button 71 turns ON and OFF lights within the oven 10. Minute timer button switches 73 and 74 adjust the timer display 72 for setting the operational time for the oven 10. When a timer count down expires, an audible alert by the annunciator 89 occurs. The fan switches 77–79 control the operation of the oven 10 in one of three possible convection heating modes, i.e. HI, LOW, and COOL, and the temperature of the oven 10 during this convection mode of operation is set by temperature button switches 81 and 82. The temperature display 80 indicates the temperature of the oven and the set point for the convection mode of operation.

Still referring to FIG. 4, a lower portion of the control panel 14 comprises the control and displays for enabling and adjusting the conduction/radiant heating modes comprising cooking zones 1–5. Zone 1 (35) is controlled by OFF switch 84*a* in oven 10, lower element switch 85*a*, and upper element switch 86*a*. In the present embodiment, one heating level may be selected for each of the cooking zones 1–5 (35–39) such as a percentage power level. The heating level selected is shown in display 80. Switch buttons 84*a*–86*e* enable zones 2–5 respectively and each of the zones 2 to zones 5 are similarly adjusted by decrement switch 81 and increment switch 82. As an alternative embodiment, a closed loop control with temperature feedback may be provided. Likewise, the heating level selected is shown in display 80. The button switches 71, 73, 74, 81, 82, 84*a*–84*e*, 85*a*–85*e*, 86*a*–86*e*, and 87*a*–87*e* may be embodied by individual push buttons or a keypad commonly known in the art. The displays 72, 76, 80 and 87*a*–87*e* may be embodied by seven segment LEDs commonly known in the art.

The variability in heating levels is achieved by use of phase-firing or pulse-width-modulation (PWM) techniques, whereby only a fixed, predetermined percentage of the power is delivered to a heating element. The precise amount is established by selection with arrow keys and can be altered by programming and keystrokes (see FIGS. 13A–13C).

Phase firing is implemented in software by delaying the time to turn on the solid state, power switches 51–60 after the zero crossing by a specific amount, e.g. 5 msec. out of the 60 Hz sine wave, which then allows only the remaining portion of each half-wave of power to reach an element. Pulse width modulation is implemented in a similar fashion by dividing a fixed period (e.g. 100 msec.) square wave into a percentage ON time and a remaining percentage OFF time, e.g. 20% ON and 80% OFF. This signal is applied to the solid state power switch, which has the result of proportioning only that percentage of power to the element. An electromechanical relay may also be used with much longer periods (e.g. 2 seconds ON and 8 seconds OFF). PWM is implemented in the preferred embodiment (see FIGS. 13A–13C).

Referring again to FIG. 2, upon power-up and each time the door 16 is opened and closed, configuration or continuity relays 92 are energized long enough to determine the panel configuration i.e. which panels 20–26 have been removed, if any, by measuring either the current flow or the continuity within a given element within a given panel 18–28. Because there are four removable panels 20–26, four relays represented by relay 92 are required to establish the configuration by means of continuity. In the normal operation state, the relays 92 pass line power to the panel elements; in the configuration state, the relays 92 pass low voltage logic power to the microcontroller 90 through the elements. Thus, the microcontroller 90 can determine the presence or absence of a panel by continuity. This configuration data is stored in memory of the microcontroller 90, and is used to determine which groups of elements are to form which zones within the oven 10 and are powered accordingly. A door switch 107 and a cut-out switch 108 are provided to control the contactor 91.

Figure 5:
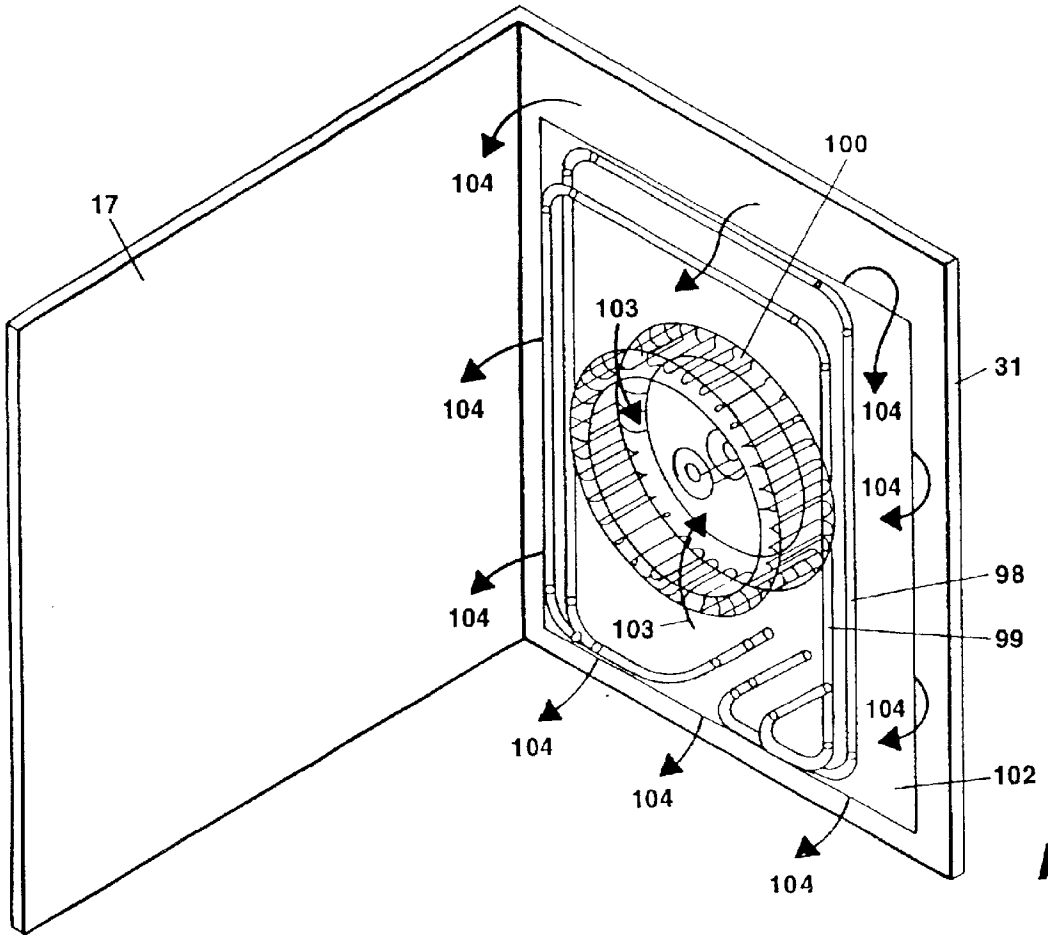
FIG. 5 is a perspective view of a multiple speed, forward curved blower showing the return air flow and the hot air flow for convective heating.

Referring now to FIG. 5, a perspective view of a multiple speed, forward curved blower wheel 100 is shown for providing heated, convected air circulation as in conventional convection ovens in combination with a 208V, single phase two speed motor along a common shaft combined with two 2500W heating elements 98 and 99 surrounding the perimeter of said blower wheel 100. All is contained behind an air circulation baffle plate 102 that receives re-circulating air 103 in the center of the baffle plate 102 and in turn, in the center of the lower wheel 100, and then redistributes the air 104 outward radially around the baffle plate 102 openings.

Referring now to FIGS. 6–14, flow charts of the software routines for the control program are provided for operating the oven 10 and controlling the panels 18–28 according to the preferred embodiment of the present invention. Entry points and exit points on the flow charts are indicated by letters A through K and a common return point is labeled RET.

Figure 6:
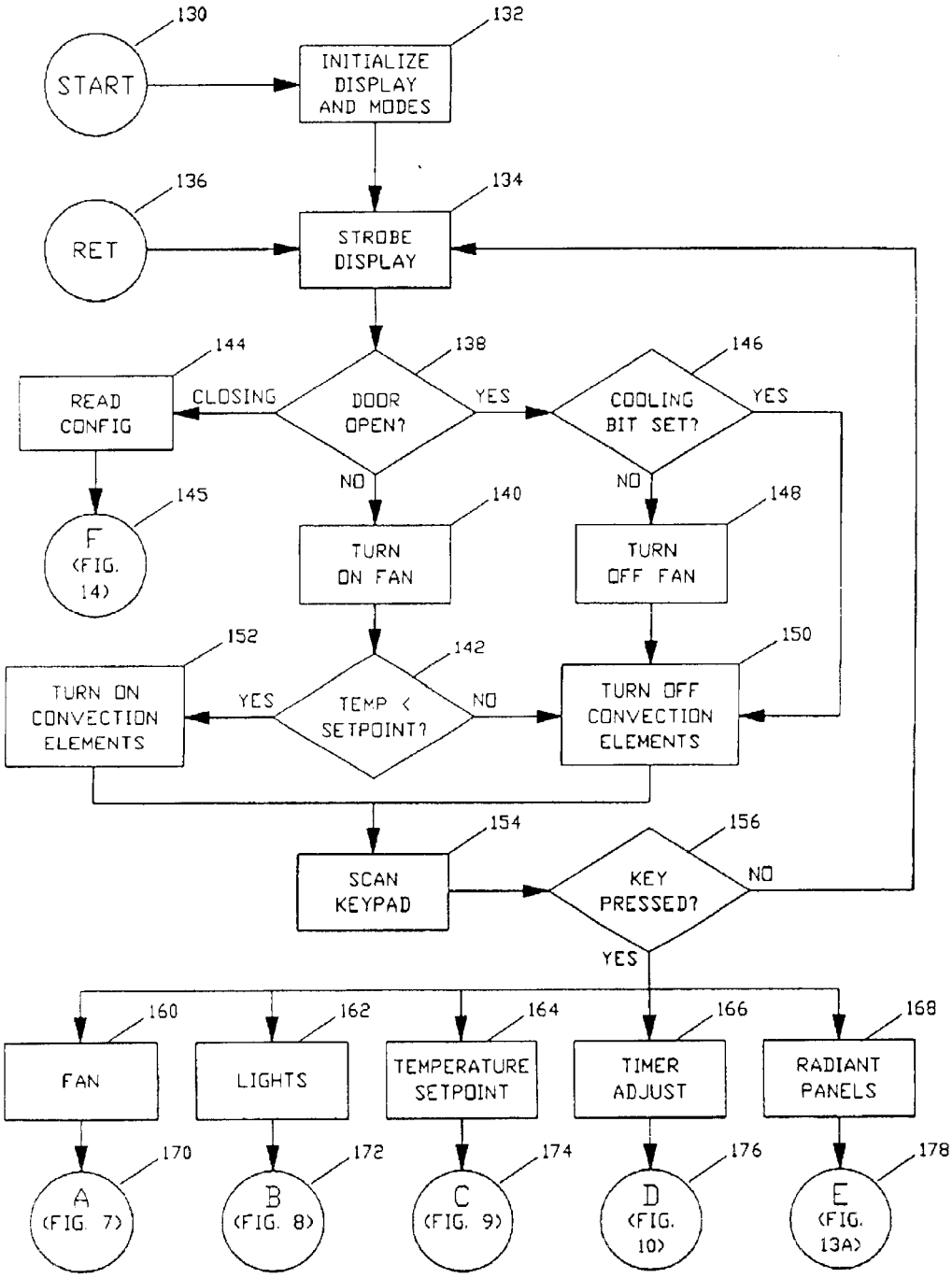
FIG. 6 is a flow chart of a software routine for initializing all displays and modes according to the present invention.

Referring to FIG. 6, a flow chart is shown of a software subroutine for initializing the cooking oven's displays and modes (HIGH, LOW and COOL). The software routine starts at entry point 130. At block 132 the displays are initialized by flashing all segments of all displays on control panel 14 (FIG. 4) and sounding the annunciator 89. Block 134 strobes the digits in the LED displays in succession. Block 138 constantly checks the door switch 107. Blocks 140, 146, and 148 determine whether the fan 97 comes on; blocks 142, 150, and 152 determine whether the convection elements come on, while the temperature setpoint comes on at the setpoint which was in effect at power down. Then in block 154 the matrix of keys on the keypad is strobed, column by column.

The temperature display 80 alternately shows the temperature read from the sensor and the setpoint; temperatures are rounded to the nearest 5 degree F. The convection heating elements are powered on in block 152 until the temperature exceeds the setpoint, with a deadband of 5 degrees F.

The "TIMER" 72 displays ':00' unless there was time remaining in the timer at power down, in which case ':00' flashes to indicate power failure. When time is entered into the countdown timer, it counts down to ':00' and sounds the annunciator 89. The display indicates whole minutes until the countdown becomes 1 minute or less, in which case it indicates seconds.

Whenever the door 16 is opened, the fan 97 and all heating elements go off, unless the 'COOL' mode has been selected and checked in block 146 whereby the fan 97 stays on.

The keypad of control panel 14 is monitored continuously; when a key is detected, another routine is entered. Block 156 reads when a key is pressed, and the control program branches to one of five other routines; blocks 160–178 execute the various branches to said routines.

Figure 7:
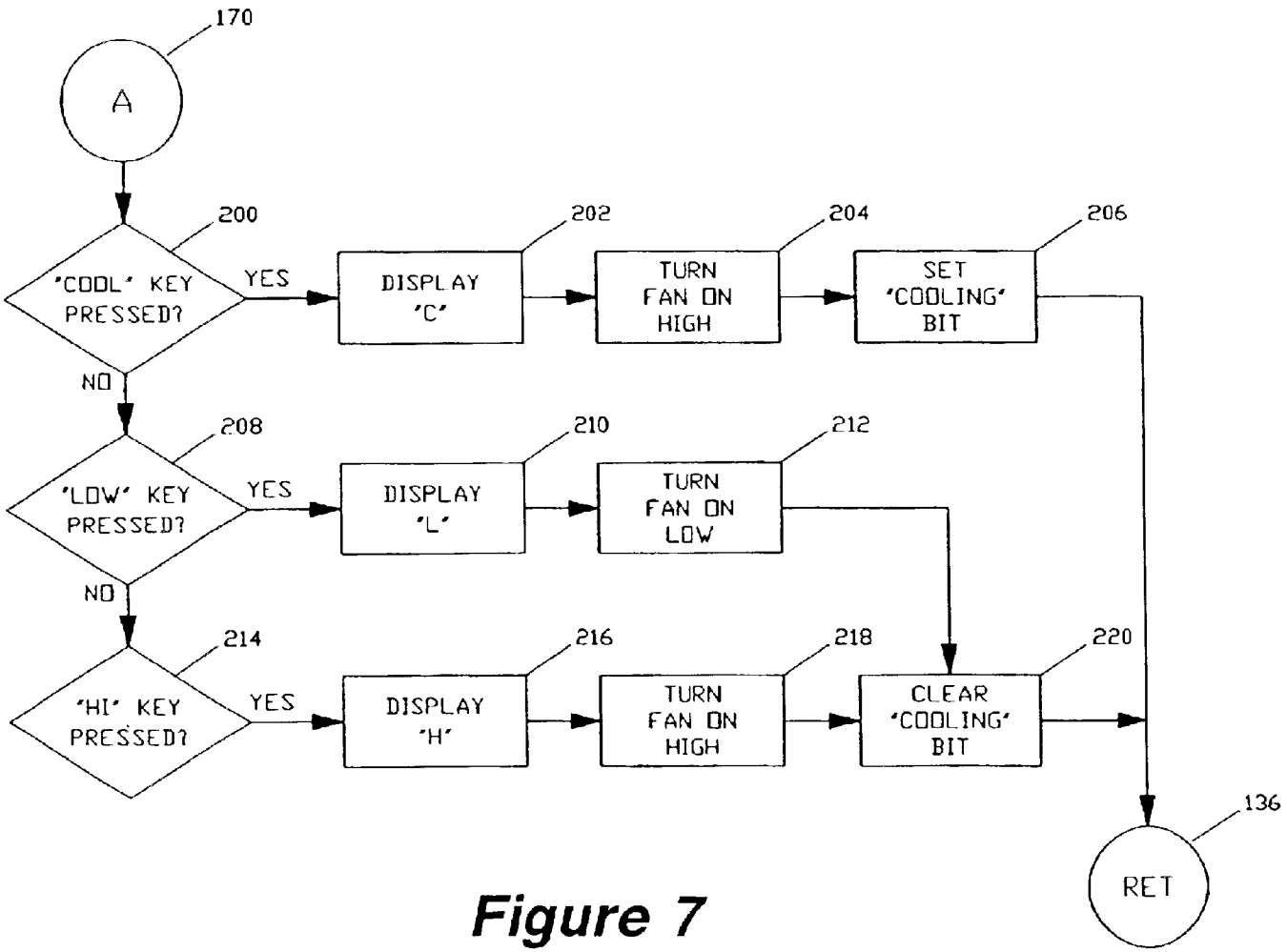
FIG. 7 is a flow chart of a software routine for the fan controls.

Referring to FIG. 7, a flow chart for the fan 97 controls software routine is shown. Blocks 200, 208, and 214 read the Fan keys "HIGH" 77, "LOW" 78, and "COOL" 79, which determine the speed of the fan 97 and the mode. Blocks 202, 210, and 216 indicate in display 76 the current fan mode by displaying the letters C, L or H. Blocks 204, 206, 212, 218, and 220 affect the fan speed; in "COOL" mode, the fan 97 stays on at high speed, even when the door 16 is opened, and the convection and conductive/radiant elements are turned off.

Figure 8:
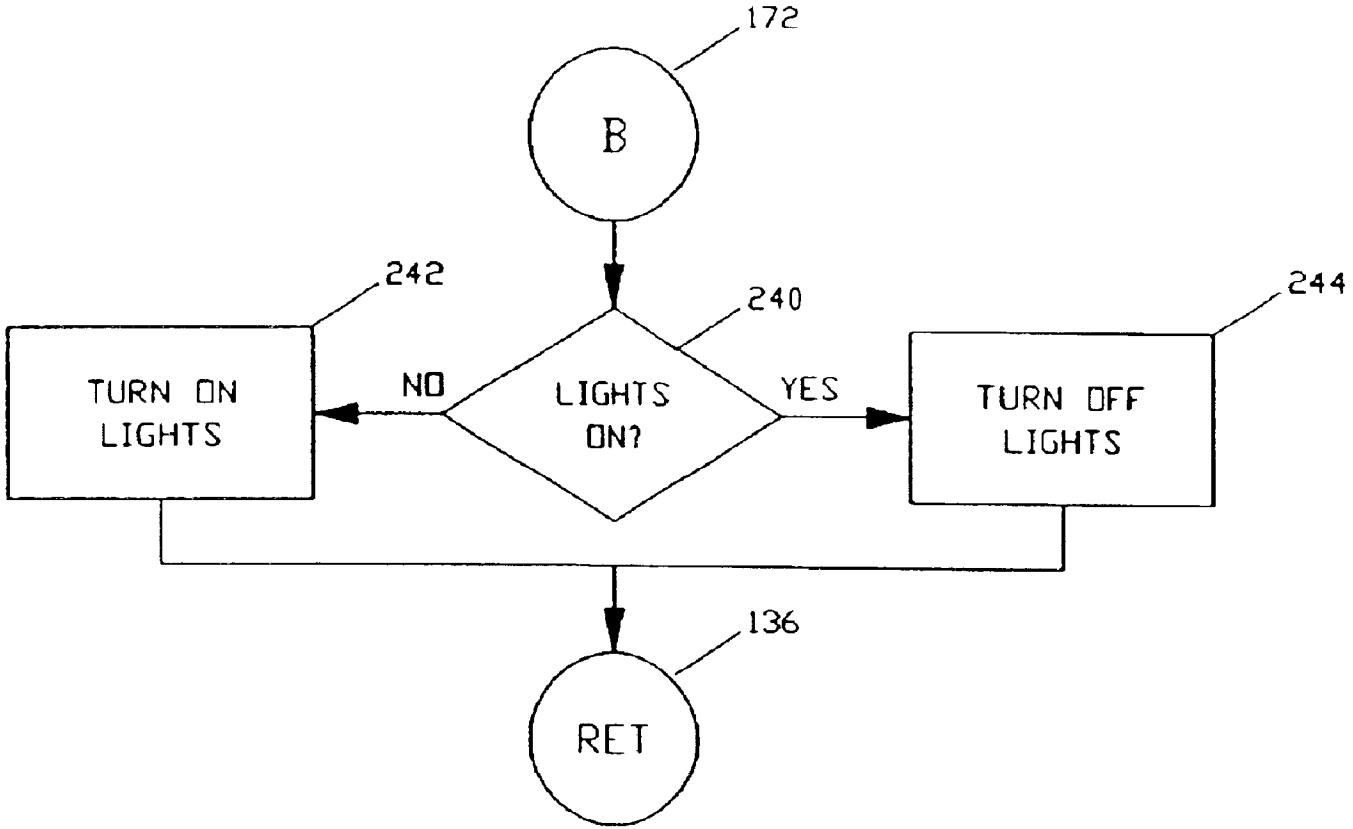
FIG. 8 is a flow chart of a software routine for the light controls.

Referring to FIG. 8, a flow chart of the software routine for the light controls is shown. Blocks 240–244 read the "LIGHT" key to toggle the halogen lights (not shown) ON and OFF located on each side 17, 19 of the oven cavity.

Figure 9:
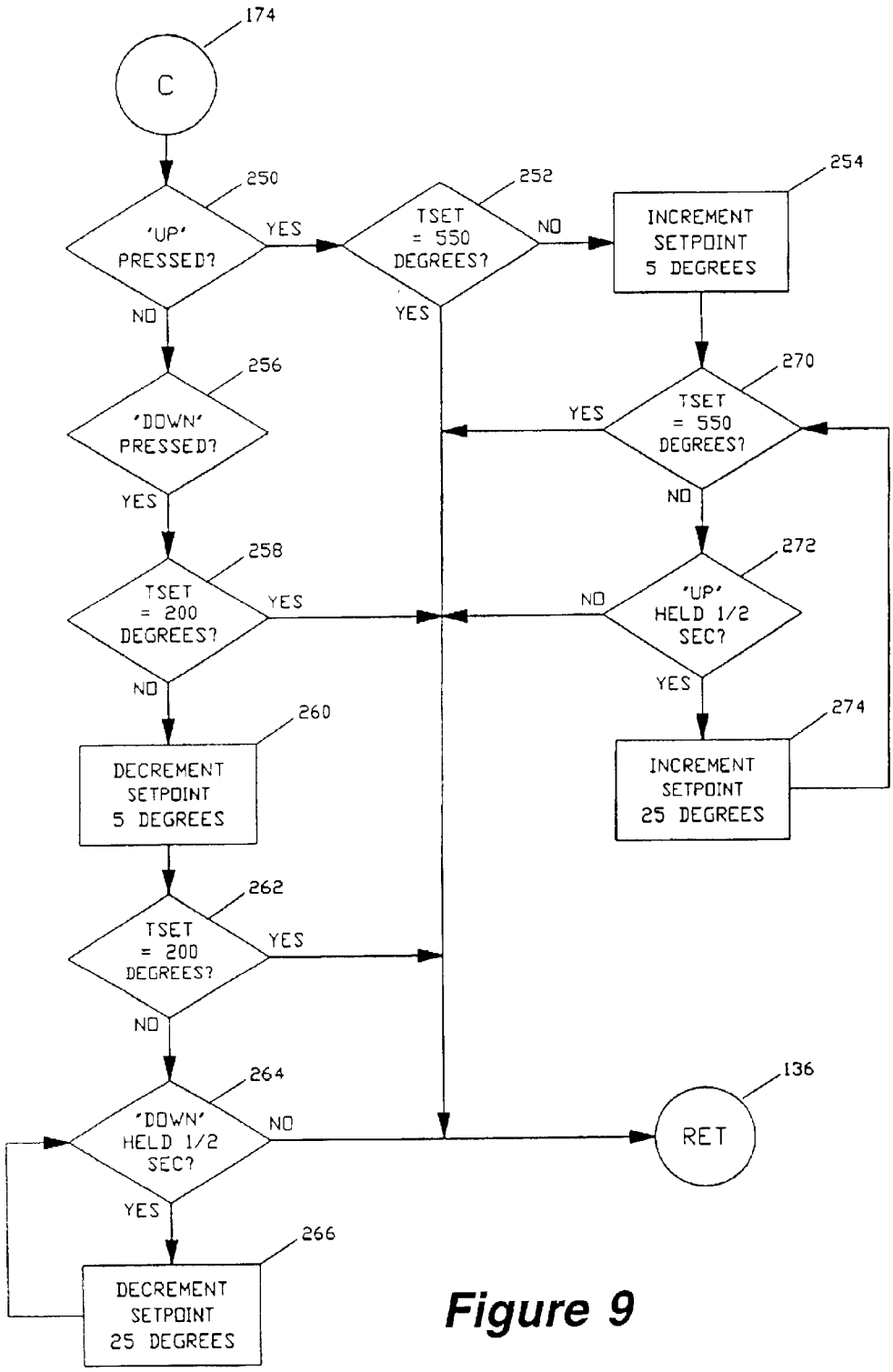
FIG. 9 is a flow chart of a software routine for the temperature set point.

Referring to FIG. 9, a flow chart of the software routine for the temperature setpoint is shown. Blocks 250–266 read the "TEMP"erature keys ("UP" arrow 82 and "DOWN" arrow 81) to increment and decrement the setpoint by 5 degrees F.; blocks 264–266 and 272–274 increment or decrement the setpoint by 25 degrees F. if the keys are held longer than ½ second. Blocks 252, 258, 262, and 270 establish temperatures from 200 degrees F. to 550 degrees F. to be valid, rounded to the nearest 5 degrees F.

Figure 10:
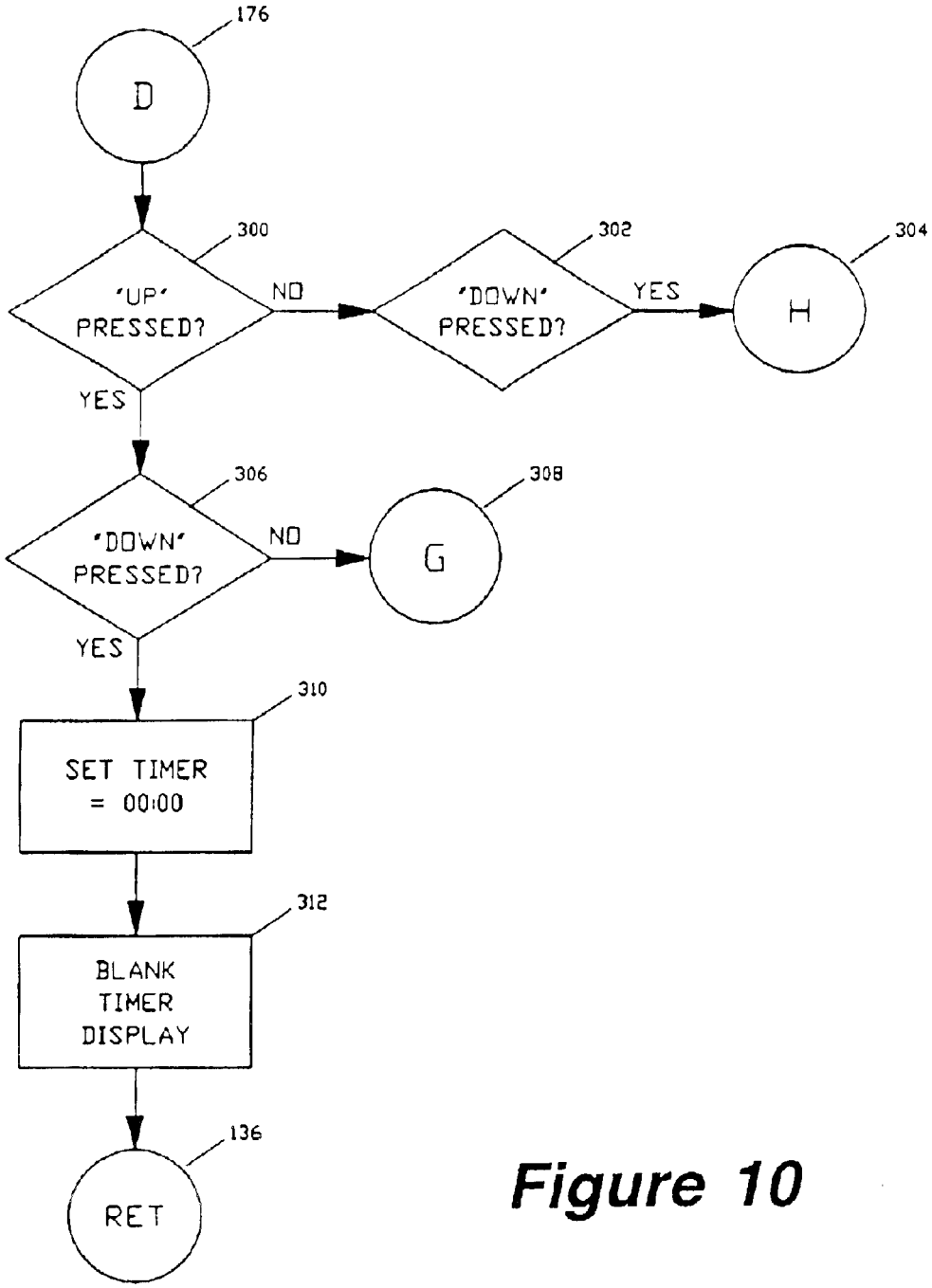
FIG. 10 is a flow chart of a software routine for the timer adjust.

Referring to FIG. 10, a flow chart of the software routine for a timer adjust is shown. Blocks 300–308 increment and decrement the countdown time using the "TIMER" keys ("UP" arrow 74 and "DOWN" arrow 73); passing through blocks 300 and 306 to blocks 310–312 results in pressing both keys, simultaneously resetting the time to ':00'.

Figure 11:
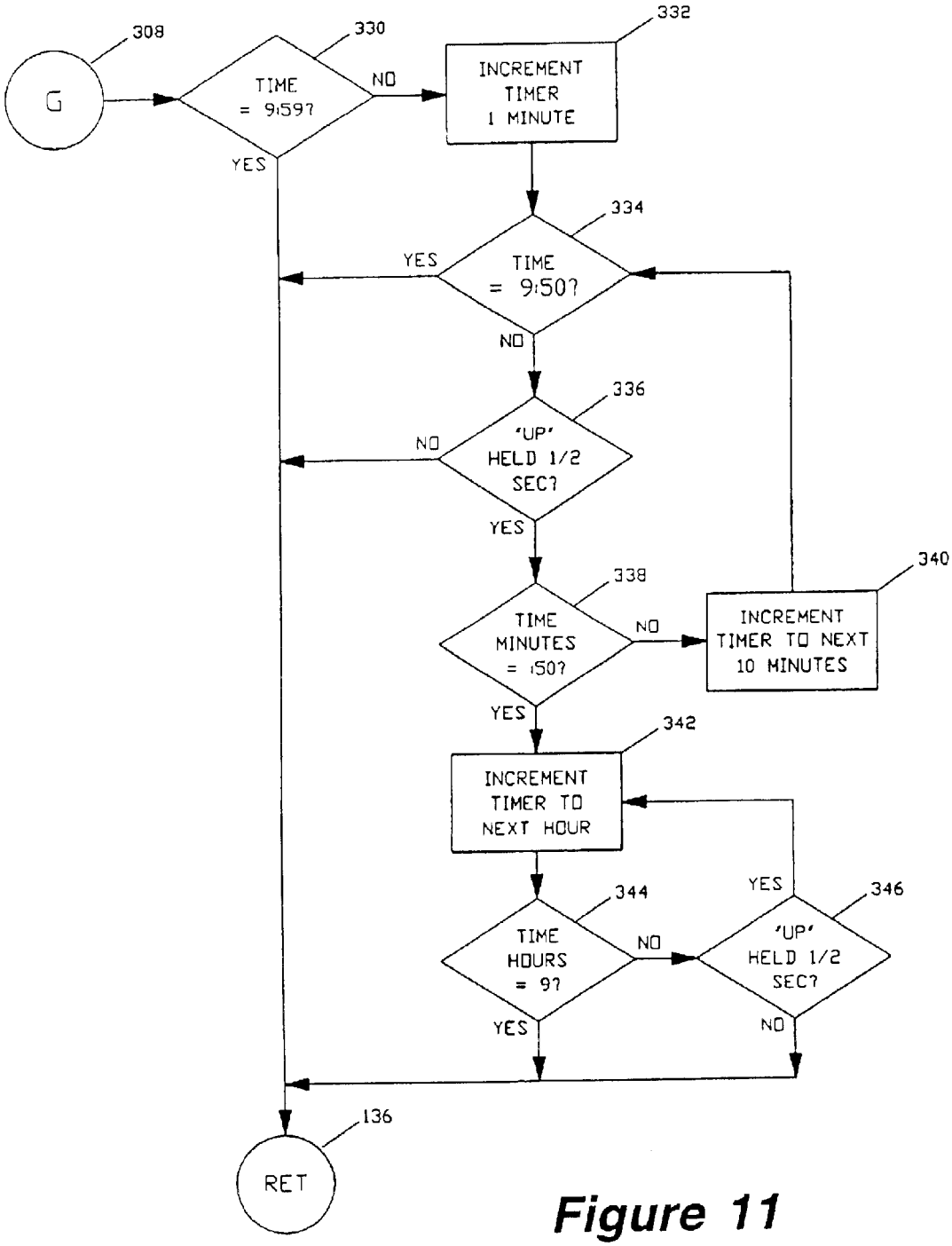
FIG. 11 is a flow chart of a software routine for incrementing the timer.

Referring to FIG. 11, a flow chart of the software routine for incrementing the timer is shown. Blocks 330–346 increment the countdown time by 1 minute, 10 minutes, or 1 hour depending on how long the "TIMER UP" arrow key 74 is held and what the current countdown time is. Block 330 allows a valid countdown time up to '9:59'. Blocks 334–340 read a key held for ½ sec or more and increment the timer to the next 10 minutes. Blocks 342–346 read a key held for ½ second or more with whole hours being displayed and increment the timer to the next hour; 9 is the largest hour value allowed.

Figure 12:
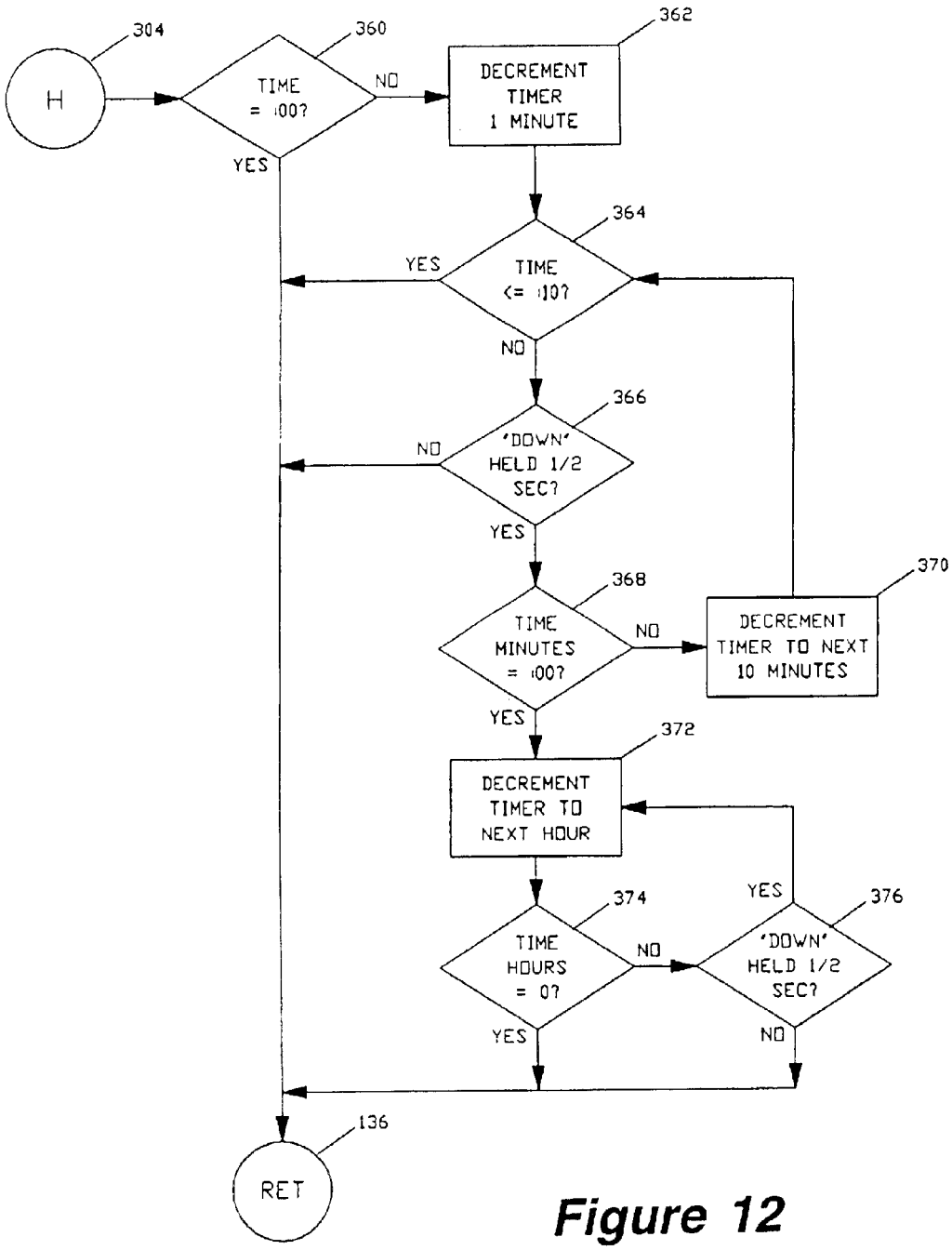
FIG. 12 is a flow chart of a software routine for decrementing the timer.

Referring to FIG. 12, a flow chart of the software routine for decrementing the timer is shown. Blocks 360–376 decrement the countdown time by 1 minute, 10 minutes or 1 hour depending on how long the "TIMER DOWN" arrow key 73 is held and what the countdown time is. Blocks 360 allows a valid countdown time down to ':00', whereby the timer function is canceled. Blocks 364–370 read a key held for ½ second or more and decrement the timer to the next 10 minutes. Blocks 372–376 read a key held for ½ second or more with whole hours being displayed and decrement the timer to the next hour; reaching '0:00' cancels the timer function.

Figure 13A:
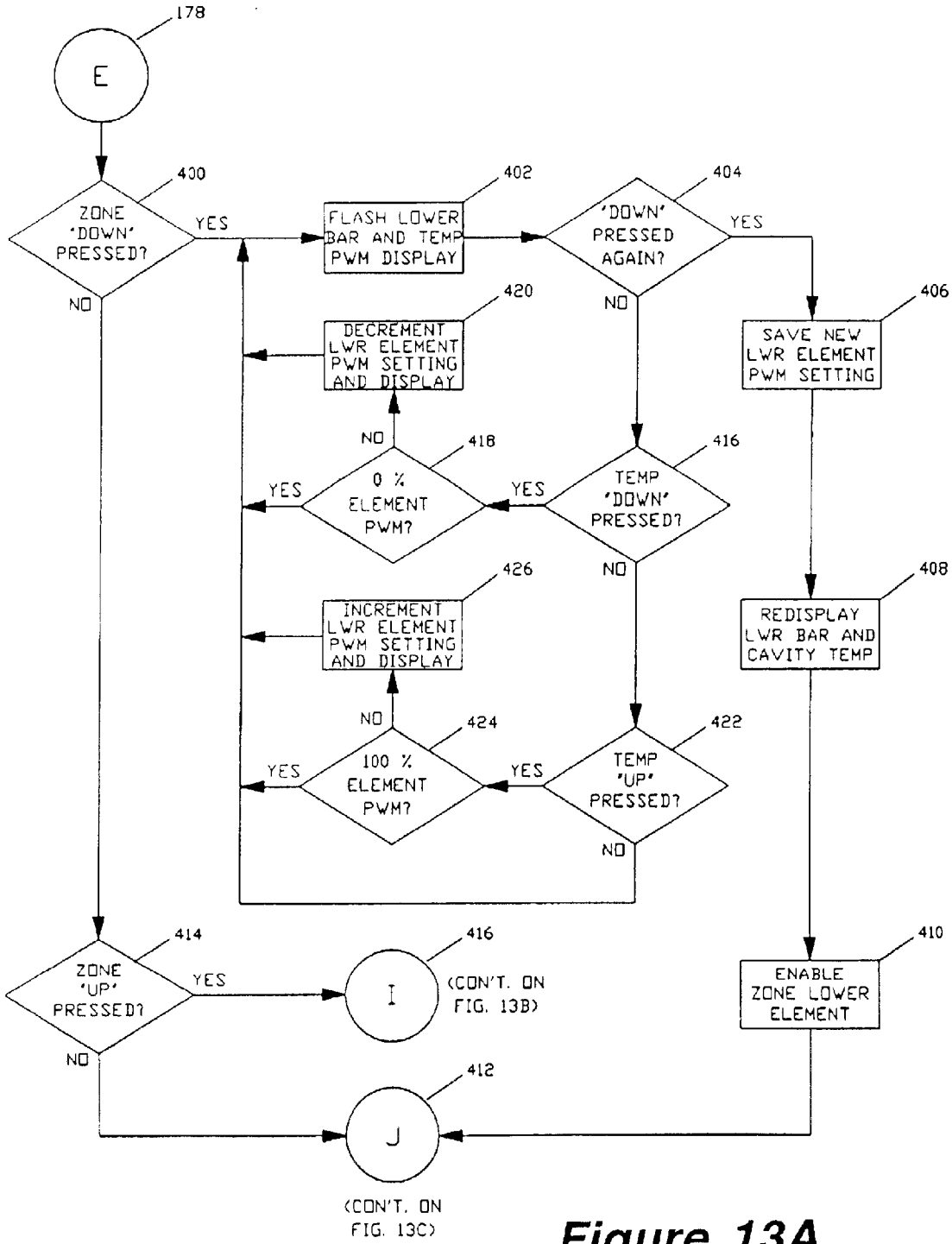
FIGS. 13A–13C are flow charts of a software routine for the control of the conductive/radiant panels.
Figure 13B:
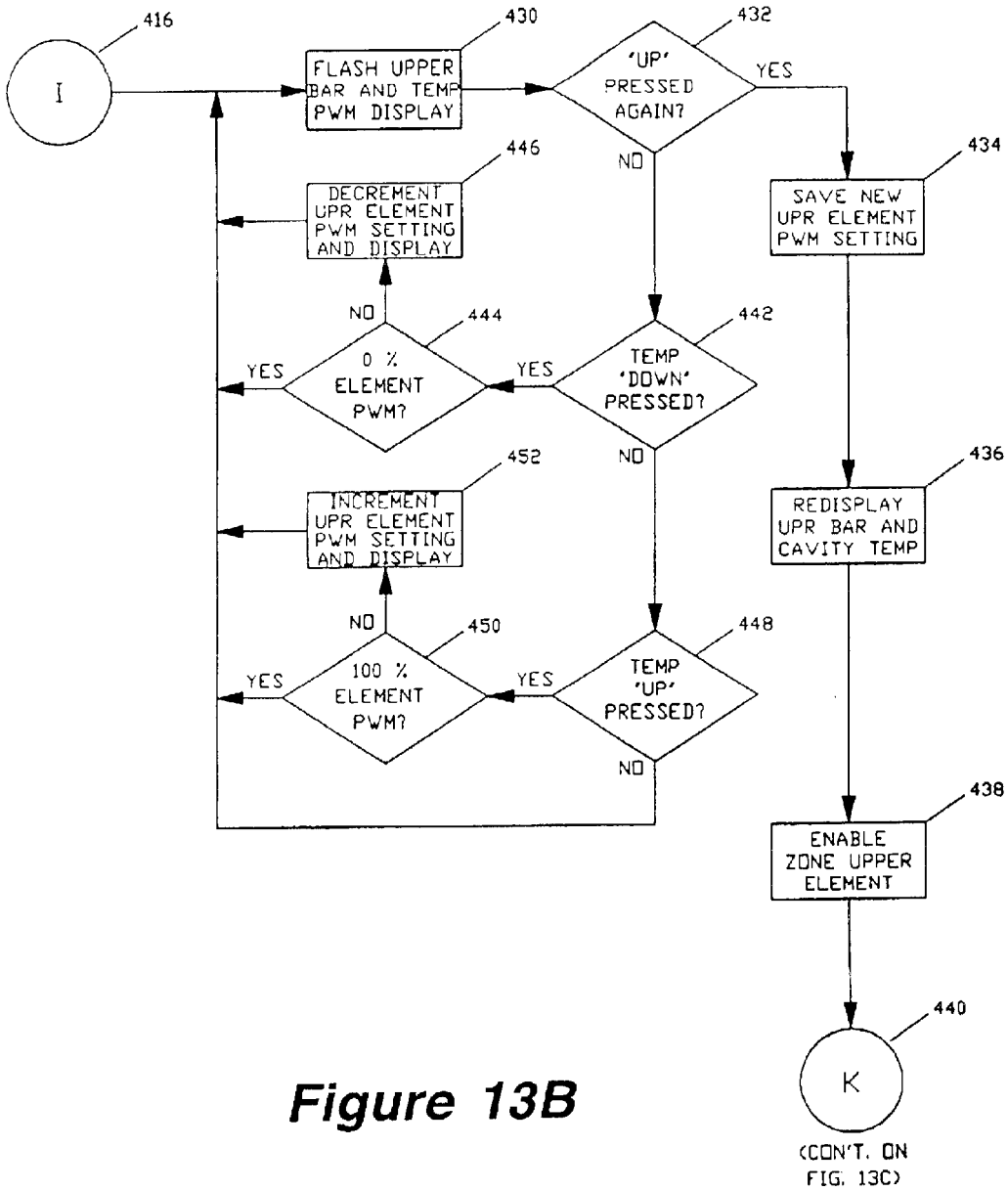
Figure 13C:
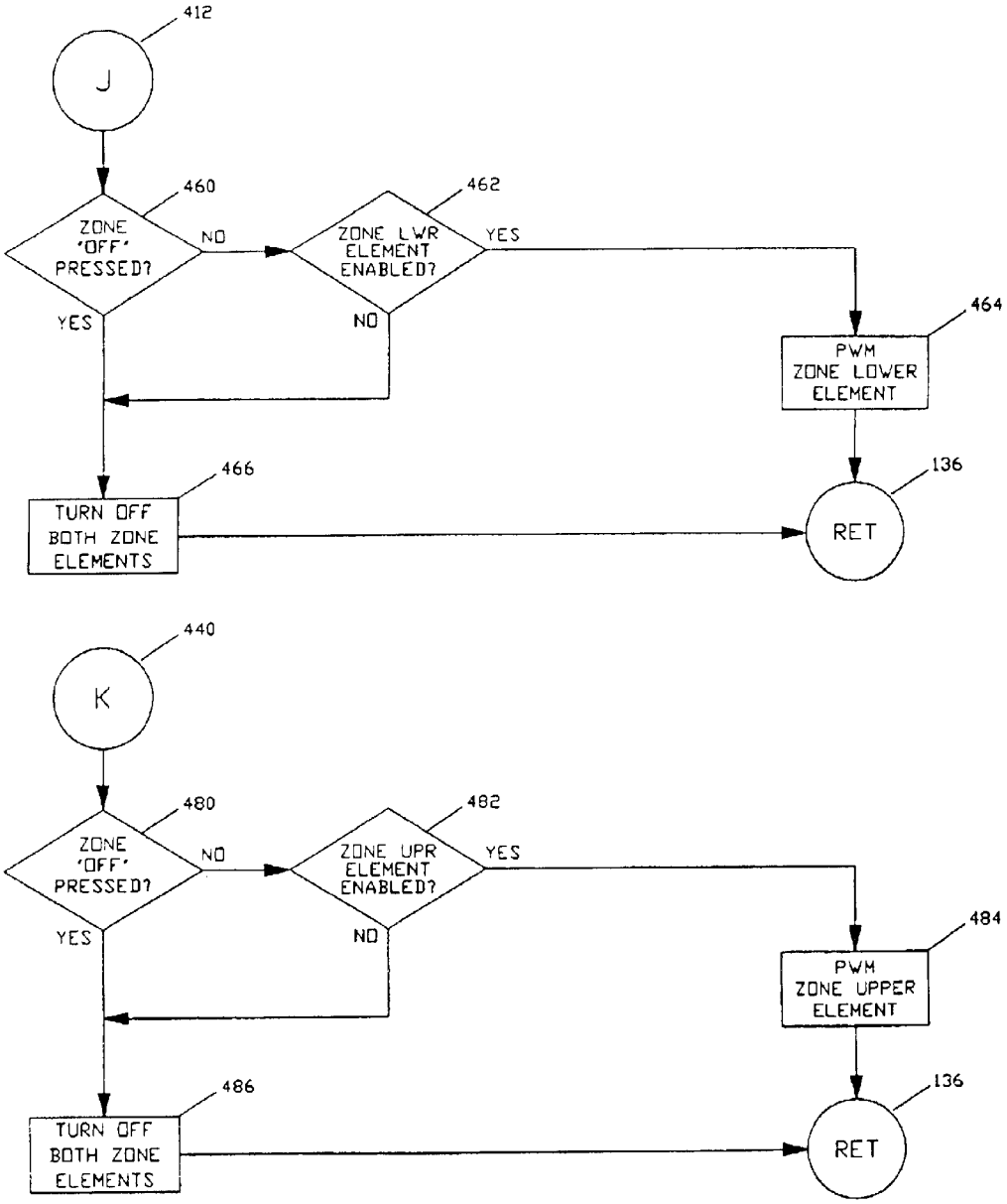

Referring to FIGS. 13A, 13B and 13C, flow charts are shown for the software routine to control the conductive/radiant panels 18–28. Referring to FIG. 4 and FIG. 13A, panel keys for zones 1–5 ("OFF" 84*a*–84*e*, "UP" arrow 86*a*–86*e*, and "DOWN" arrow 85*a*–85*e*) determine the power levels delivered to the individual elements on each of the individual panels 18–28. Eleven predetermined levels ('0–100%') are selected by the "TEMP"erature arrow keys 81, 82. Blocks 400–404 read one of the five Zone 'DOWN' arrow keys 85*a*–85*e* and flash the lower bar of the display for that zone. Blocks 416–420 read the "TEMP"erature "DOWN" key 81, decrementing the pulse width modulation (PWM) percentage (%) power level in steps of 10% down to 0%. Blocks 422–426 read the "TEMP"erature "UP" arrow key 82, incrementing the PWM % power level in steps of 10% up to 100%. Blocks 406–410 save the new value, display a lower bar, redisplay cavity temperature, and enable the lower element for that zone. Blocks 414–416 read a Zone "UP" arrow key (86*a*–86*e*).

Referring to FIG. 13B, FIG. 13B is a continuation of the flow chart FIG. 13A for the control of the conductive/radiant panels 18–28. Blocks 430–432 read one of the five Zone "UP" arrow keys 85*a*–85*e* and flash the upper bar of the display for that zone. Blocks 442–446 read the "TEMP"erature "DOWN" key 81, decrementing the PWM % power level in steps of 10% down to 0%. Blocks 448–452 read the "TEMP"erature "UP" arrow key 82, incrementing the PWM % power level in steps of 10% up to 100%. Blocks 434–440 save the new value, display an upper bar, redisplay cavity temperature, and enable the upper element for that zone.

Referring to FIG. 13C, FIG. 13C is a continuation of the flow chart from FIG. 13B for the control of the conductive/radiant panels 18–28. Blocks 460–462 and 466 and blocks 480–482 and 486 read the Zone "OFF" key and remove power from a zone 35–39 (pair of radiant/conductive elements—FIG. 2). Block 464 powers a zone lower element while block 484 powers a zone upper element.

Figure 14:
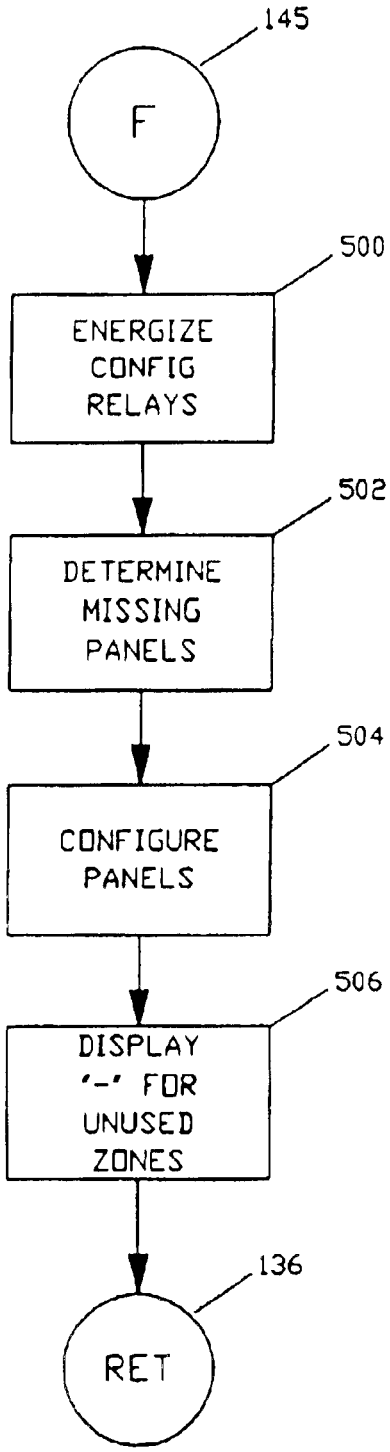
FIG. 14 is a flow chart of a software routine for determining the radiant panel configuration.

Referring to FIG. 14, a flow chart is shown of a software routine for determining the panel configuration of the oven 10. Each time the oven 10 is powered up or the door 16 is opened and then closed, block 500 energizes a set of relays 92 to measure either current flow or continuity in the conductive/radiant elements. Block 502 determines the configuration; block 504 places the configuration in memory to determine which zones 35–39 are in effect. Block 506 then displays a '–' to indicate an unused zone. Zones are removed from service from the bottom (zone 5) up, regardless of which panel(s) have been removed.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A cooking oven comprising:

a heat insulated cabinet having a top, bottom, rear and side walls and an access door attached to the front of the cabinet;

a plurality of heating panels spaced-apart within said cabinet, each of said panels having an upper and a lower surface and comprising means for heating said upper surface of each of said panels and means for heating said lower surface of each of said panels, said upper surface and said lower surface of each panel being separated by insulation;

means connected to said heating panels for separately controlling the heat output of each upper surface of each of said plurality of heating panels;

means connected to said heating panels for separately controlling the heat output of each lower surface of each of said plurality of panels;

said cooking oven comprises a control panel positioned adjacent to said access door for providing a user interface with controls and displays; and said control panel monitors the electrical current or continuity powering each of said panels as a means for reconfiguring the size of each of the heating zones formed between said spaced-apart panels.

2. The cooking oven as recited in claim 1 wherein said oven comprises means for providing a convection heating mode of operation.

3. The cooking oven as recited in claim 1 wherein said oven comprises a processor connected to said control panel for operating said cooking oven in response to signals received from said control panel.

4. The cooking oven as recited in claim 1 wherein said upper surface of said panels provides conduction heating for a first cooking tray placed on said upper surface of a first one of said heating panels and said lower surface of said first one of said panels provides radiant heating for a second cooking tray placed on an adjacent second one of said panels under said lower surface of said first one of said healing panels.

5. The cooking oven as recited in claim 1 wherein said upper surface of said panels comprises means for providing conduction and radiant heating for a first cooking tray placed on said upper surface of a first one of said heating panels and said lower surface of said first one of said panels provides radiant heating for a second cooking tray placed on an adjacent second one of said panels under said lower surface of said first one of said heating panels.

6. The cooking oven as recited in claim 1 wherein said upper surface of said panels provides radiant heating for a first cooking tray placed slightly above said upper surface of a first one of said heating panels and said lower surface of said first one of said panels provides radiant heating for a second cooking tray placed on or slightly above an adjacent second one of said panels under said lower surface of said first one of said heating panels.

7. The cooking oven as recited in claim 1 wherein said means for separately controlling said heat output of said upper surface of said plurality of heating panels comprises a software routine operating in response to control signals from a user interface panel.

8. The cooking oven as recited in claim 1 wherein said means for separately controlling said heat output of said lower surface of said plurality of heating panels comprises a software routine operating in response to control signals from a user interface panel.

9. The cooking oven as recited in claim 1 wherein each of said upper surface of each of said panels and each of said lower surface of each of said panels comprises:

a metal substrate;

a dielectric applied to said metal substrate; and a thermal film ink bonded to said dielectric.

10. The cooking oven as recited in claim 9 wherein said dielectric comprises a borosilicate glass.

11. The cooking oven as recited in claim 1 wherein said upper surface of said panels and said lower surface of said panels comprises a resistive element embedded in an insulative bed.

12. The cooking oven as recited in claim 1 wherein said oven comprises means for enabling each of said panels to be connected or disconnected from said cooking oven.

13. A method of providing a cooking oven comprising the steps of:

providing a heat insulated cabinet having a top, bottom, rear and side walls and an access door attached to the front of said cabinet;

positioning a plurality of heating panels spaced-apart within said cabinet, each of said panels having an upper and a lower surface and comprising means for heating said upper surface of each of said panels and means for heating said lower surface of each of said panels, said upper surface and said lower surface of each panel being separated by insulation;

controlling individually said upper surface heating means for each of said panels;

controlling individually said lower surface heating means for each of said panels;

providing a control panel adjacent to said access door to provide a user interface with controls and displays; and monitoring electrical current or continuity to each of said heating panels to facilitate reconfiguring the size of each heating zone formed between said heating panels.

14. The method as recited in claim 13 wherein said method comprises the step of providing a convection heating mode of operation.

15. The method as recited in claim 13 wherein said method comprises the step of providing a processor connected to said control panel for operating said cooking oven in response to signals received from said control panel.

16. The method as recited in claim 13 wherein said step of positioning a plurality of heating panels within said cabinet, each of said panels having an upper surface and a lower surface and comprising means for heating said upper surface and said lower surface further comprises the step of providing conduction heating for a first cooking tray placed on said upper surface of a first one of said heating panels and said lower surface of said first one of said panels providing radiant heating for a second cooking tray placed on an adjacent second one of the heating panels under said lower surface of said first one of said heating panels.

17. The method as recited in claim 13 wherein said step of positioning a plurality of heating panels within said cabinet, each of said panels having an upper surface and a lower surface and comprising means for heating said upper surface and said lower surface further comprises the step of providing means for conductive heating and radiant heating a first cooking tray placed on said upper surface of a first one of said heating panels and said lower surface of said first one of said panels providing radiant heating for a second cooking tray placed on an adjacent second one of the heating panels under said lower surface of said first one of said heating panels.

18. The method as recited in claim 13, wherein said step of positioning a plurality of heating panels within said cabinet, each of said panels having an upper surface and a lower surface and comprising means for heating said upper surface and said lower surface further comprises the step of providing radiant heating for a first cooking tray placed slightly above said upper surface of a first one of said heating panels and said lower surface of said first one of said panels providing radiant heating for a second cooking tray placed on or slightly above an adjacent second one of the heating panels under said lower surface of said first one of said heating panels.

19. The method as recited in claim 13 wherein said step of positioning a plurality of heating panels spaced-apart within said cabinet, each of said panels having an upper and a lower surface further comprises the step of providing said upper surface with peaks and valleys for conductive and radiant heating.

20. The method as recited in claim 13 wherein said step of controlling individually said upper surface heating means for each of said panels comprises the step of providing a software routine to operate in response to control signals from a user interface panel.

21. The method as recited in claims 13 wherein said step of controlling individually said lower surface heating means for each of said panels comprises the step of providing a software routine to operate in response to control signals from a user interface panel.

* * * * *